United States Patent [19]

Vasovich

[11] Patent Number: 4,494,522

[45] Date of Patent: Jan. 22, 1985

[54] SIZE DRESSER FOR GRINDING WHEELS

[76] Inventor: Dimitrije R. Vasovich, 749 E. Brokaw Rd., San Jose, Calif. 95112

[21] Appl. No.: 490,342

[22] Filed: May 2, 1983

[51] Int. Cl.[3] ..... B24B 53/12

[52] U.S. Cl. ..... 125/11 DF; 51/281 SF; 125/39

[58] Field of Search ..... 125/11 R, 11 ST, 11 DF, 125/39; 51/118, 281 SF, 162

[56] References Cited

U.S. PATENT DOCUMENTS

| | | | |
|---|---|---|---|
| 362,360 | 5/1887 | Convers | 125/39 |
| 2,377,822 | 6/1945 | Starn | 125/11 R |
| 2,390,967 | 12/1945 | Swenson | 125/11 R |
| 2,501,374 | 3/1950 | Bley | 125/39 |
| 2,726,650 | 12/1955 | Failla | 125/11 R |
| 2,928,384 | 3/1960 | Slupecki | 125/11 ST |

OTHER PUBLICATIONS

Industrial Diamond Review, Article by John Waller, vol. 20, p. 196, Oct. 1960.

*Primary Examiner*—Harold D. Whitehead

[57] ABSTRACT

The present invention is a size dressing apparatus (10) particularly adapted for sizing rotary grind wheels. The apparatus includes a base block (12) of generally rectangular solid shape and formed to include a vertical transverse gap (14) or slot and a cylindrical axial bore (16) intersecting the gap (14). A large abrasive and support point (20) is stationarily positioned within the gap (14) along the bore (16) axis while a second, smaller abrasive point (22) is movably positioned opposite the first point (20) along the axis. A positioning assembly (24), including a micrometer position control (44) knob for precisely setting the axial position of the second abrasive point, is provided in the axial bore (16) opposite from the first abrasive point (20). The apparatus (10) is especially intended for dressing very narrow grinding wheels to precise tolerances.

19 Claims, 2 Drawing Figures

SIZE DRESSER FOR GRINDING WHEELS

TECHNICAL FIELD

The present invention relates generally to mechanical tooling devices and more particularly to devices for modifying the size and shape of grinding wheels. The predominant current usage of the invention is to dress the sides of grinding wheels to mill them to precise width such that the grinding wheels may be used to grind precise slots in slabs or strips of material.

BACKGROUND ART

The tool and die industry deals with the manufacture and modification of mechanical elements and tools. One of the tools frequently utilized in the industry is a rotary grinding wheel. Rotary grinding wheels may be utilized as tools for shaping the exterior portions of various elements or for removing imperfections. However, they may also be used as a cutting element similar in some ways to a saw in that a grinding wheel may be used to grind a slot in a slab or a sheet of material. The present invention deals with this application of the tool.

A rotary grinding wheel is a quantity of abrasive material bonded together to form a regular symmetrical disk having a discrete thickness. The particular type of abrasive material, the binding material and the dimensions are all selected in accordance with the particular use to which the grinding wheel is to be put.

The present invention regards methods and devices for modifying the width of a grinding wheel and dressing it to a particular uniform width along a significant portion of its radius. In the past, this has been accomplished by rotating the grinding wheel rapidly while bringing one side of the wheel into contact with a point or edge of material which is harder and more abrasive than the material of the wheel. Since grinding wheels are typically constructed of carborundum or powdered diamond suspensions it is usually necessary that the abrasive edge or point be diamond, since the milling will only be possible with an agent harder than or of equal hardness to the wheel material.

One commonly used prior art method of dressing the size or width of the grinding wheel is to use a diamond point on one side of the wheel and a positioning element, such as a flat plate parallel to the plane of rotation of the wheel, on the other side. Typically, either the diamond point or the positioning plate is spring loaded such that the wheel is urged into the proper orientation but is not forced. After one side of the wheel has been properly dressed then the other side is treated in a similar manner. This method has been entirely adequate for use with grinding wheels of macroscopic widths and relatively large dimensional tolerances.

However, with the explosive development of industries regarding micro-miniature circuitry, there has arisen a concurrent need for grinding wheels having very narrow widths and very precise tolerances. It has been found that the prior art methods do not dress the wheels with sufficient accuracy for these applications. The prior art size dressing methods frequently lead to relevant differences in thicknesses along the radius of the wheel as well as occasional spiraling which may lead to resulting grinding wheels similar in shape to a warped phonograph record. Such results are unacceptable.

In response to the difficulties encountered in dressing very narrow grinding wheels, the art has responded with some very sophisticated and complex devices. These have included micrometer type spacing controls both on the positioning plate and on the diamond tip and various other means of precisely positioning the abrasive elements. These complex methods have been more successful at solving the problem than earlier efforts, but have been difficult and expensive to manufacture and require constant adjustment to maintain them in proper orientation. None of the prior art devices adequately solve the problems involved in grinding wheels for the electronics industry in a simple and easily manufactured and utilized manner.

DISCLOSURE OF INVENTION

Accordingly, it is an object of the present invention to provide a size dresser for grinding wheels which quickly and easily dresses wheels of very narrow thickness to precise tolerances.

It is another object of the present invention to provide a size dresser in which the positioning element also acts as an abrasive milling element.

It is a further object of the present invention to provide a size dresser which may be precisely set for a given width and which will require only minor readjustment during the dressing procedure.

The present invention is a size dresser for grinding wheels which is particularly adapted for utilization with grinding wheels utilized to cut very narrow slots in elements or sheets utilized in the electronics industry. The invention is especially intended for use in dressing the sides of the grinding wheel to very narrow thicknesses and precise tolerances such that the slots subsequently cut by the grinding wheel are narrow and extremely precise.

Briefly, a preferred embodiment of the present invention is a size dressing apparatus utilized for milling the sides of grinding wheels. The apparatus includes a stationary massive block including a transverse vertical gap and an axial bore extending through the block perpendicular to the vertical gap and extending completely through the block on both sides of the gap. A stationary solid cylinder having an abrasive point is inserted into the axial bore on one side of the gap with the abrasive point extending within the gap. The stationary cylinder is held in position by a set screw. A second smaller abrasive point is delivered into the gap opposing the first abrasive point by a positioning assembly. The positioning assembly delivers the second abrasive point along the axis of and through the axial bore in a manner in which the axial position of the second abrasive point may be controlled by rotating a micrometer knob. The first and second abrasive points are linearly aligned along the axis of the bore and the distance of separation between is precisely controlled by rotation of the micrometer knob. The positioning assembly includes a hollow tube for containing a threaded pin having the second abrasive point mounted on its end, a tensioning spring, a collar element, a measuring ring and a positioning knob. These elements work in combination to precisely control the location of the second abrasive point.

When the invention is utilized, a grinding wheel is arrayed vertically within the gap such that the plane of rotation is perpendicular to the axis of the bore. The two abrasive points are then adjusted to contact the sides of the wheel. The grinding wheel is then rotated and the abrasive points dress the sides simultaneously.

The wheel is then radially moved such that dressing is accomplished over the entire desired radial portion of the disk. The larger abrasive point provides both positioning support and rough dressing while the smaller point provides fine dressing.

It is an advantage of the present invention that the opposed abrasive points simultaneously dress both sides of the grinding wheel.

It is another advantage of the present invention that the separation between the abrasive points may be precisely adjusted by the positioning assembly.

It is a further advantage of the present invention that the use of two abrasive elements prevents the occurrence of "warping" in the grinding wheels.

It is yet another advantage of the present invention that the combination of a larger stationary abrasive element and a smaller movable abrasive element in an axial alignment significantly reduces breakage of wheels during ordinary size dressing usage, as compared with prior art methods.

These and other objects and advantages of the present invention will become clear to those skilled in the art in view of the description of the best presently known mode of carrying out the invention and the industrial applicability of the preferred embodiment as described herein and as illustrated in the several figures of the drawing.

BEST MODE OF CARRYING OUT INVENTION

The best presently known mode of carrying out the invention is a size dressing apparatus particularly adapted for operation on abrasive grinding wheels. The size dressing apparatus is particularly characterized by a stationary larger abrasive area and readily adjustable smaller abrasive area axially aligned with each other and separated by a space equal to the desired width of the grinding wheel. The improved size dressing apparatus is especially adapted for providing sizing of very narrow abrasive wheels to very low tolerances, without significant breakage or damage to the wheels. The size dressing assembly is a portable element which may be taken to various sights for working on various types of grinding wheels. The primary intended use of the invention is to dress the size of very narrow grinding wheels which are utilized in cutting slots in sheets or slabs of material.

Figure 1:
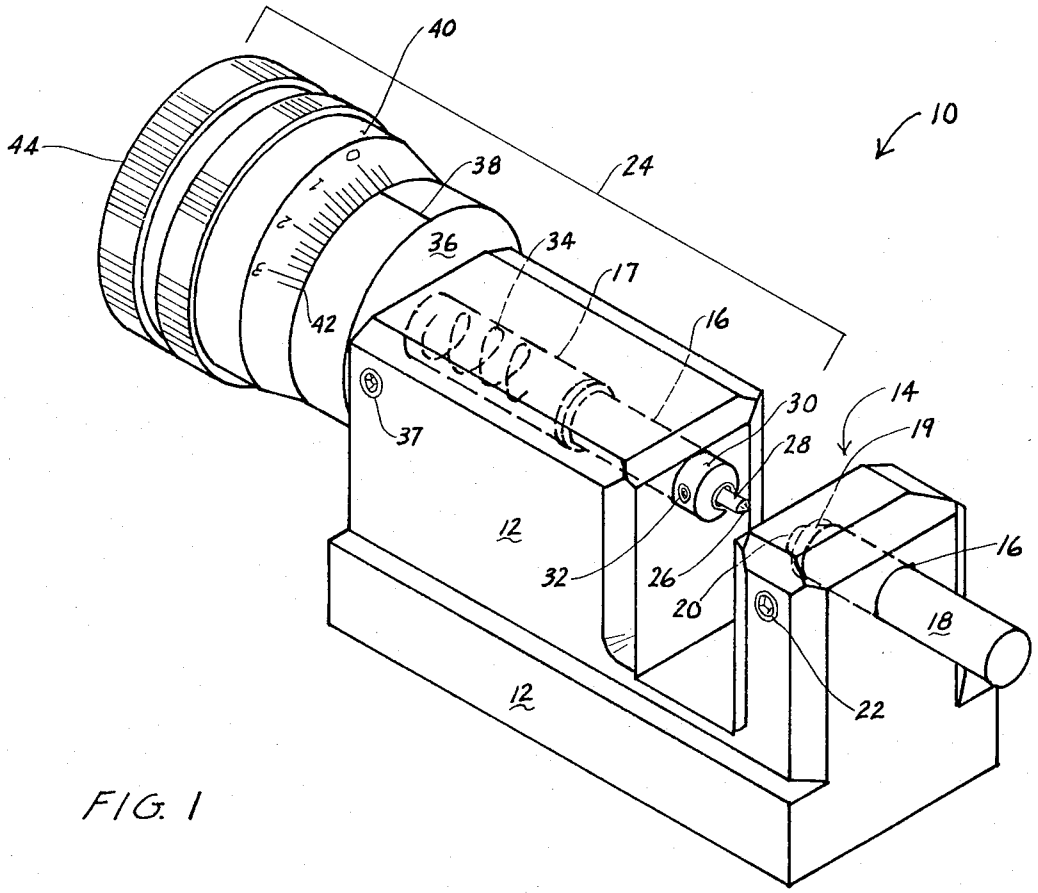
FIG. 1 is a perspective view of a size dressing apparatus for grinding wheels in accordance with the present invention.

The presently preferred embodiment of the size dressing apparatus is illustrated in a perspective view in FIG. 1, and is designated by the general reference character 10. The most prominent element of the assembly 10 is a massive block 12. The block 12 is a solid element generally in the shape of a rectangular solid. A transverse vertical gap 14 is formed near one end of the rectangular solid block 12. The vertical gap or slot 14 is formed perpendicular to the major axis of the block 12, extends entirely across the width of the upper portion of the block 12 and is sufficiently wide to allow insertion of a typical grinding wheel and to also allow manipulation of elements within the gap 14.

The block 12 further includes a cylindrical axial bore 16 formed therethrough. In the preferred embodiment, the axial bore 16 is formed to be centered in the vertical plane of the major axis of the block 12 and is situated in the upper portion of the block 12 . The axial bore 16 is in two segments, with one segment being on each side of the vertical gap 14. The segments of the bore 16 are linearly aligned with each other. A widened segment 17 is formed along the axial within the larger portion of the block 12 bore 16. The widened segment 17 is distinguished in that it has a greater diameter than the remainder of the bore 16. The widened segment 17 extends from the end of the block 12 inward to a point along the axis of the bore 16 separated from the vertical gap 14. The widened segment 17 is entirely co-axial with the axial bore 16.

A solid cylinder 18 extends through the segment of the axial bore 16 on narrow side of the block across the vertical gap 14 from the widened segment 17. The stationary solid cylinder 18 includes, on the end extending into the vertical gap 14, a truncated conical section 19. A large stationary abrasive point 20 is bonded onto the flat end of the truncated conical section 19. The large stationary abrasive point 20 is typically a piece of industrial diamond. The cylinder 18 is slidable within the axial bore 16 and may be positioned such that the large diamond 20 may be situated anywhere along the bore axis within the vertical gap 14. Once the desired position of the large diamond 20 has been accomplished the positioning is locked by a set screw 22 which extends into the block 12 and holds the solid cylinder 18 firmly in position. The cylinder 18 may also be rotated within the bore 16 to provide for changing the leading abrasive surface of the large diamond 20 as wear requires.

The opposite portion of the axial bore 16 from that holding the solid cylinder 18 provides a housing for portions of a positioning assembly 24. A portion of the positioning assembly 24 extends through widened segment 17 and the axial bore 16 into the vertical gap 14 and culminates in a second, small abrasive point 26. The small abrasive point 26 is also typically a diamond. It differs from the large diamond 20 in that it is smaller and typically formed to a finer point. The purpose of the positioning assembly 24 is to adjust the position of the small abrasive point 26 with respect to the large abrasive point 20 along the axis of the bore 16. The relative spacing of the two abrasive points 20 and 26 determines the width of the sized grinding wheel.

The small diamond 26 is bonded to the end of a threaded pin 28 which extends into the vertical gap 14 through the center of a hollow tube 30. The amount by which the threaded pin 28 extends through the hollow tube 30 is secured by a set screw 32 extending into the hollow tube 30.

The hollow tube 30 is inserted into the axial bore 16 from the end of the widened segment 17. A tensioning spring 34 is placed about the hollow tube 30 prior to insertion such that the tensioning spring 34 rests against the end of the widened segment 17 and the ridge at the exterior end of the hollow tube 30 in such a manner as to urge the hollow tube 30 away from the vertical gap 14. The action of the tensioning spring 34 insures that the small abrasive point 26 is held in a manner which prevents it from extending into the vertical gap 14 any distance greater than that desired.

The positioning assembly 24 further includes a collar 36, a portion of which extends a short distance into the widened segment 17 of the axial bore 16 and is firmly held in position by a set screw 37. The collar 36 includes a registration mark 38 on its exterior in the form of an axial line along the circumference of the collar 36.

A measuring ring 40 extends about a portion of the exterior of the collar 36 for the purpose of ascertaining the degree of rotation of the measuring ring 40. The rotation of the measuring ring 40 provides an analog to the magnitude of the change in the axial position of the small diamond 26. The measuring ring 40 includes a graduated section 42 arrayed opposite the registration mark 38. The graduated section 42 is graduated about its entire circumference with markings which allow the user to determine the particular rotational positioning of the measuring ring 40.

The actual positioning of the small diamond 26 is modified and controlled by a positioning knob 44. The positioning knob 44 may be turned in either direction to adjust the amount of extension of the small diamond 26 into the vertical gap 14. The measuring ring 40 is frictionally caused to rotate, in conjunction with the positioning knob 44, with respect to the block 12, whereas the collar 36 is stationary. This causes the graduated section 42 to move with respect to the registration mark 38 such that the degree of rotation may be measured and, analagously, the axial positioning of the small diamond 26 may be controlled in a measurable manner.

Figure 2:
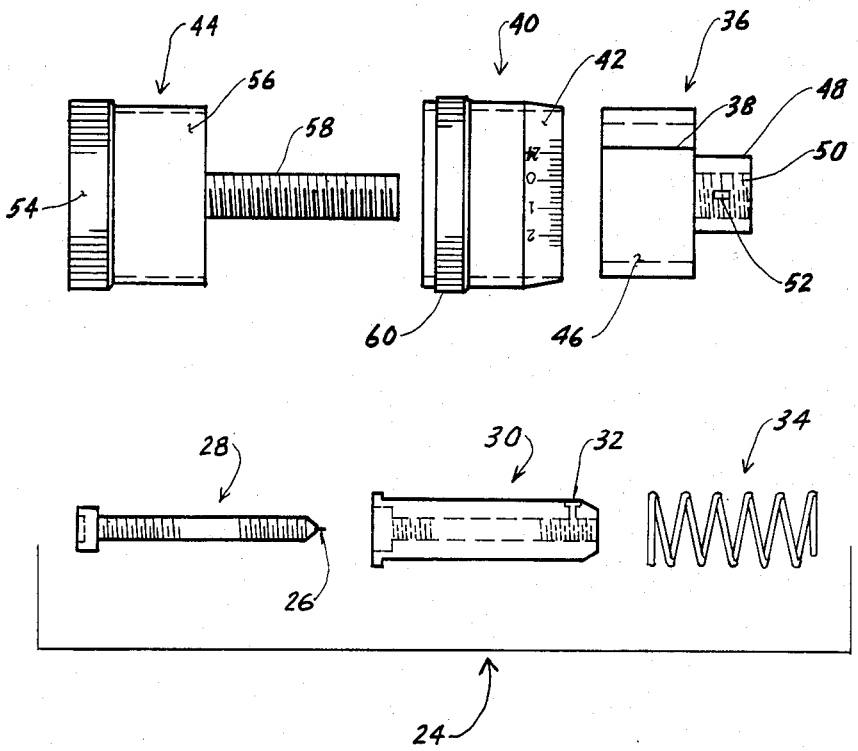
FIG. 2 is an exploded view of the elements of the positioning assembly portion of the size dressing apparatus.

The positioning assembly 24 is illustrated more clearly in an exploded view in FIG. 2. In this view it may be seen that the threaded pin 28 is basically cylindrical with a truncated conical section on one end and a head at the opposite end. The small diamond 26 is bonded to the flat portion of the truncated conical section. The threaded pin 28 further includes exterior threads about the circumference which mate with interior threads formed on the inside of the hollow tube 30. Thus, the threaded pin 28 is screwed into the hollow tube 30 to desired distance and the position is then secured by tightening the set screw 32. The head of the threaded pin 28 is provided with a hexagonal cavity or a straight slot such that the rotation and screw positioning of the pin 28 within the tube 30 may be adjusted with conventional tools.

The particular construction of the collar 36 is also illustrated in FIG. 2. In this illustration it may be seen that the collar 36 includes a collar cylinder 46 which remains entirely outside the block 12 and a collar extension 48, also cylindrical in shape, which extends into the block 12 within the widened segment 17. Both the collar cylinder 46 and the collar extension 48 are hollow to permit the passage of other elements. The collar extension 48 is provided with interior threading 50 and, in one embodiment of the invention, is provided with an optional set screw slot 52 on the exterior of the collar extension 48 for receiving the end of set screw 37. The mating between set screw 37 and set screw slot 52 prevents the collar 36 from sliding or rotating with respect to the block 12. This assures that the only movement of small diamond 26 with respect to block 12 is deliberately caused by the rotation of the positioning knob 44.

As is shown in FIG. 2, the positioning knob 44 includes a grasping ring 54 which is roughened to provide for easy gripping and turning of the position knob 44 by the user. The positioning knob 44 also includes a seating cylinder 56 about which the measuring ring 40 slidably rests. The remaining element of the positioning knob 44 is a threaded lead screw 58. The threads of lead screw 58 are adapted to mate with the interior threading 50 of the collar 36. Lead screw 58 and interior threading 50 are very finely threaded such that a complete rotation of the positioning knob 44 results in a very small axial movement of the end of the lead screw 58 within the collar 36 and the axial bore 16. Consequently, the axial position of small diamond 20 may be very precisely adjusted.

FIG. 2 also illustrates that the measuring ring 40 is also provided with a roughened grasping ring 60. Since the measuring ring 40 is only frictionally held in position on the seating cylinder 56 it is possible to turn the measuring ring 40 independently of the positioning knob 44. This permits the user to set the zero point on the graduated section 42 at whatever rotational position is desired. This provides for easy recognition of the relative rotational position of the positioning knob 44 with respect to a preselected position.

The size dressing aparatus 10 is assembled as follows. The stationary solid cylinder 18 is inserted into the shorter segment of the axial bore 16 such that the large diamond 20 extends within the vertical gap 14 to a desired position. The position is then established and maintained by tightening the set screw 22 to hold the stationary solid cylinder 18 in place.

The positioning assembly 24 is installed within the block 12 by inserting the threaded pin 28, including the small diamond 26 bonded to the end thereof, within the hollow tube 30. The position of the threaded pin 28 is maintained by the mating of the threads on the threaded pin 28 and those within the hollow tube 30 and also by the set screw 32.

The tensioning spring 34 is then placed over the hollow tube 30 such that it rests against the ridge at one end of the tube 30. The tube 30 and the accompanying elements are then inserted into the widened segment 17 of the axial bore 16. The end of the tensioning spring 34 comes into contact with the interior end of the widened segment 17. This provides a means of tensioning the positioning assembly 24. In this manner the hollow tube 30, and consequently the threaded pin 28 and the small diamond 26, are urged axially out of the vertical gap 14. The collar 36 is then inserted into the widened segment 17 behind the tube 30 such that the collar extension 48 is entirely inserted into the block 12. The set screw 37 is then tightened such that the collar 36 is firmly held in position. If the collar 36 is provided with a set screw slot 52 the collar 36 is rotated such that the slot 52 aligns with the set screw 37 prior to tightening.

The measuring ring 40 is then frictionally slid onto the seating cylinder 56 of the positioning knob 44 such that the graduated section extends away from the grasping ring 54 of the positioning knob 44. The threaded lead screw 58 is then inserted into the interior threading 50 of the collar extension 48 and the positioning knob 44 is turned until the threaded lead screw extends through the collar extension 48 and comes into contact with the end of the hollow tube 30 and the threaded pin 28. At this point the graduated section 42 of the measuring ring 40 rests about the exterior of the collar cylinder 46 such that the graduations on the graduated section 42 are directly aligned with the registration mark 38 on the collar 36.

Once the end of the threaded lead screw 58 has come into contact with the end of the threaded pin 28 and the hollow tube 30, further rotation of the positioning knob 44, in conjunction with the action of the tensioning spring 34, will cause the small diamond 26 to move axially either into or out of the vertical gap 14, depending upon the direction of the rotation. Once a reference position has been established the measuring ring 40 may be independently rotated such that the zero position on the graduated section 42 is aligned with the registration mark 38.

The threaded pin 28 has a length of 4.8 cm (1.9 inch) and a cylindrical section diameter of 0.33 cm (0.17 inch). The collar 36 has a length of 3.0 cm (1.2 inch). The collar cylinder has an outside diameter of 3.5 cm (1.4 inch) and an inside diameter of 2.8 cm (1.1 inch). The measuring ring 40 has a length of 2.4 cm (0.9 inch) and the graduated section 42 is divided into twenty-five equally spaced circumferential graduations, each subdivided into five equal segments. The positioning knob has a maximum diameter of 4.1 cm (1.6 inch). The seating cylinder 56 has an outside diameter of 3.7 cm (1.5 inch) and has insignificant wall thickness. The lead screw 58 has a total length of 6.0 cm (2.4 inch), a diameter of 0.9 cm (0.3 inch) to the outside of the threads. The lead screw 58 is threaded to have sixteen turns/cm (40 turns/inch). The large diamond 20 is ordinarily selected to be approximately four to twelve times larger than the small diamond 26. The small diamond 26 is also typically formed to have a sharper point than the larger diamond 20.

Those skilled in the art will readily observe that numerous modifications and alterations of the assembly may be made while retaining the teachings of the invention. Accordingly, although the invention is described above in terms of the best presently known mode of practice the disclosure is not intended as limiting. The appended claims are therefore to be interpreted as encompassing the entire spirit and scope of the invention.

INDUSTRIAL APPLICABILITY

The size dressing apparatus of the present invention is readily adaptable for immediate industrial usage in the field of electronic industry tooling. Numerous thin, precise grinding wheels are required to cut accurately sized slots in sheets of material for circuitry uses. Therefore a corresponding need exists for tools for producing the appropriate wheels. The present invention in one such tool.

The size dressing apparatus disclosed herein is of particular industrial applicability since it represents a significant improvement over prior art equipment. The present invention is easily manufactured and easily operated. It partially dresses one side of the wheel while simultaneously fine dressing the opposite side. The apparatus may also be set for very precise milling without requiring complex manipulation.

For all of the above reasons it is believed that the present invention will have immediate and widespread industrial utility and will maintain such applicability for a significant future period.

I claim:

1. A size dressing apparatus for disklike elements, comprising:

a base block having a transverse gap and an axial bore formed therethrough;

means for securing a first abrasive element along the axis of said bore at a point within said gap; and positioning means for positioning a second abrasive element smaller than said first abrasive element, along the axis of said bore at points within said gap opposing said first abrasive element.

2. The apparatus of claim 1 wherein the positioning means include:

an elongated pin having said second abrasive point bonded to one end thereof;

tensioning means for urging said elongated pin axially away from said first abrasive point; and rotary micrometer means for urging said elongated pin axially toward said first abrasive point.

3. The apparatus of claim 2 wherein :

said elongated pin includes a threaded pin extending within and through a hollow tube having internal threading for mating with the threading on said threaded pin and a set screw for securing said threaded pin at a selected axial position with respect to said hollow tube.

4. The apparatus of claim 3 wherein:

said tensioning means include an expansion spring abutting at one end against a portion of said hollow tube and at the other end against an abutment within said axial bore.

5. The apparatus of claim 2 wherein said rotary micrometer means further include:

a collar secured within said axial bore and being internally threaded; and a lead screw threaded through said collar so as to abut against the end of said elongated pin such that rotation of said lead screw in one direction urges said elongated pin toward said first abrasive point.

6. The apparatus of claim 5 and further including:

a positioning knob concentrically bonded to said lead screw and having a diameter significantly greater than that of said lead screw.

7. The apparatus of claim 5 and further including:

a measuring ring having graduations such that the degree of rotation of said lead screw may be readily observed.

8. The apparatus of claim 1 wherein:

said first abrasive element is between four and twelve times larger than said second abrasive element.

9. The apparatus of claim 1 wherein:

said first abrasive element and said second abrasive element are selected to be diamond.

10. The apparatus of claim 1 wherein the means for securing the first abrasive point include:

a cylindrical solid element having the first abrasive point secured to one end thereof, said cylindrical solid having a diameter slightly less than that of said axial bore, said cylindrical solid being slidably placed within a portion of said axial bore such that the first abrasive point extends into said transverse gap; and a set screw for securing the position of said cylindrical solid.

11. An apparatus for dressing and sizing rotary grinding wheels, comprising:

a solid base including a vertical gap and a linear bore formed therein, said bore divided into two segments with one on each side of said gap;

a large abrasive point secured to the end of a stationary holding element held in position within one segment of said bore such that the abrasive point extends within said gap; and a positioning assembly, a part of which is contained within the segment of said bore opposite said gap from the large abrasive point, including means for precisely positioning a small abrasive point along the axis of said bore at points within said gap opposite the large abrasive point.

12. The apparatus of claim 1 wherein:

the solid base is generally in the shape of a rectangular solid, said linear bore is cylindrical and aligned along the axis of the base and said vertical gap has a rectangular cross sectional shape.

13. The apparatus of claim 12 wherein:

the large abrasive point is a diamond and said stationary holding element is a solid cylinder held in axial position within said bore by a set screw.

14. The apparatus of claim 12 wherein the positioning assembly includes:

a threaded pin having said small abrasive point secured to one end thereof;

a hollow cylinder having interior threads for receiving said threaded pin;

tensioning means for urging said threaded pin axially away from the large abrasive point; and micrometer means for urging said threaded pin axially toward the large abrasive point.

15. The apparatus of claim 14 wherein:

said linear bore includes a widened section within the segment containing the positioning assembly; and said tensioning means include a tensioning spring compressed between the interior end of said widened section and a detent formed on said hollow cylinder.

16. The apparatus of claim 14 wherein said micrometer means include:

a collar fixed to the base and including interior threading; and a positioning knob including a lead screw for mating with the threading of said collar and extending therethrough to abut against said threaded pin and hollow cylinder.

17. The apparatus of claim 16 and further including:

a measuring ring mounted on said positioning knob for alignment opposite a fixed registration mark such that the degree of rotation of the positioning knob may be readily observed.

18. The apparatus of claim 17 wherein:

the large abrasive point is a diamond and said stationary holding element is a solid cylinder held in axial position within said bore by a set screw.

19. The apparatus of claim 18 wherein:

said second abrasive point is a diamond, between one-fourth and one-twelfth the size of said first abrasive point and being sharpened to a finer point than said first abrasive point.

* * * * *